United States Patent [19]

Schwuger et al.

[11] 4,148,603

[45] Apr. 10, 1979

[54] METHOD OF WASHING TEXTILES AND COMPOSITION CONTAINING INORGANIC SILICATES AND POLYCARBOXYLATES AND/OR POLYPHOSPHONATES

[75] Inventors: Milan J. Schwuger, Haan; Heinz Smolka, Langenfeld; Manfred Rostek, Düsseldorf, all of Fed. Rep. of Germany

[73] Assignee: Henkel Kommanditgesellschaft auf Aktien, Düsseldorf, Fed. Rep. of Germany

[21] Appl. No.: 873,381

[22] Filed: Jan. 30, 1978

Related U.S. Application Data

[63] Continuation-in-part of Ser. No. 778,977, Mar. 18, 1977, abandoned, which is a continuation of Ser. No. 618,460, Oct. 1, 1975, abandoned.

[30] Foreign Application Priority Data

Oct. 4, 1974 [AT] Austria ..... 8001/74

[51] Int. Cl.[2] ..... B08B 3/00

[52] U.S. Cl. ..... 8/137; 252/89 R; 252/131; 252/140; 252/179

[58] Field of Search ..... 8/137; 252/89 R, 542, 252/179, 131, 140

[56] References Cited

U.S. PATENT DOCUMENTS

| | | | |
|---|---|---|---|
| 3,030,181 | 4/1962 | Milton | 23/113 |
| 3,266,973 | 8/1966 | Crowley | 162/164 |
| 3,518,200 | 6/1970 | Fitch et al. | 252/89 |
| 3,755,180 | 8/1973 | Austin | 252/99 |
| 3,925,262 | 12/1975 | Laughlin et al. | 252/526 |
| 3,962,132 | 6/1976 | Haschke et al. | 252/430 |
| 3,962,149 | 6/1976 | Chirash et al. | 252/540 |
| 4,083,793 | 4/1978 | Jakobi et al. | 252/99 |

FOREIGN PATENT DOCUMENTS 1333810 10/1973 United Kingdom.

*Primary Examiner*—A. Lionel Clingman
*Attorney, Agent, or Firm*—Hammond & Littell

[57] ABSTRACT

A method of treating soiled textiles, wherein the soiled textiles are immersed in an aqueous liquor which contains at least two compounds inhibiting alkaline earth metal ion precipitation on said soiled textiles comprising using (1) from 0.2 to 10 gm of anhydrous active substance per liter of at least one finely-dispersed, water-insoluble silicate compound having a calcium-binding power of at least 50 mg CaO/gm of anhydrous active substance and having the formula, combined water not shown $$(M_{2/n}O)_x \cdot Me_2O_3 \cdot (SiO_2)_y$$

where M is a cation of the valence n, exchangeable with calcium, x is a number of from 0.7 to 1.5, Me is aluminum or boron, and y is a number from 0.8 to 6, and (2) from 0.05 to 2gm/l of at least one of certain polyphosphonates; as well as washing compositions containing said at least two compounds.

4 Claims, No Drawings

METHOD OF WASHING TEXTILES AND COMPOSITION CONTAINING INORGANIC SILICATES AND POLYCARBOXYLATES AND/OR POLYPHOSPHONATES

This application is a continuation-in-part of application Ser. No. 778,977, filed Mar. 18, 1977, and now abandoned which in turn is a continuation of application Ser. No. 618,460, filed Oct. 1, 1975, and now abandoned.

BACKGROUND OF THE INVENTION

As known, the detergents used in the household, in commercial establishments and in industry, frequently contain large quantities of condensed phosphates, particularly tripolyphosphates. These are provided to sequester the hardness formers of tap water and are responsible to a great extent for increasing the cleaning power of the capillary-active washing substances. The phosphorus content of these agents has been criticized by the public in connection with questions of the protection of the environment. The view is frequently expressed that the phosphates, which arrive in the rivers and lakes after treatment of the sewage, have great influence on the eutrophication of the waters, and is said to lead to an increase of the growth of algae and of oxygen consumption. It has therefore been tried to eliminate phosphate from the washing and cleaning processes or from the agents used for this purpose, or at least to substantially reduce its proportion.

Copending, commonly-assigned U.S. Patent Application Ser. No. 458,306, filed Apr. 5, 1974, now abandoned in favor of continuation Application Ser. No. 800,308, filed May 25, 1977, and its continuation-in-part application Ser. No. 599,012, filed July 24, 1975 now abandoned, discloses a process for the washing, bleaching or cleaning of solid materials, particularly textiles, by treating these materials with a liquor containing compounds able to bind the cations that make water hard. The process is characterized in that finely-dispersed, water-insoluble silicate compounds having calcium-binding capacity of at least 50 mg CaO/gm of anhydrous active substance (AS) and having the formula I, combined water not shown $$(M_{2/n}O)_x.Me_2O_3.(SiO_2)_y \qquad (I)$$

where M is a cation of the valence n, exchangeable with calcium, x is a number from 0.7 to 1.5, Me is aluminum or boron, and y is a number from 0.8 to 6, preferably from 1.3 to 4, are suspended in the aqueous treatment bath. The process of the patent makes possible the complete or partial replacement of phosphates that bind calcium ions by complexing and are still being used in the washing and cleaning process.

The calcium-binding capacity of the above-defined compounds may reach values of 200 mg CaO/gm AS and is preferably in the range of 100 to 200 mg CaO/gm AS. The above-defined compounds capable of binding calcium are referred to as "aluminosilicates" in the following text, for the sake of simplicity. This applies particularly to the sodium aluminosilicates that are to be used preferably. All data given for their preparation and processing apply accordingly to the totality of the above aluminosilicate compounds as defined in said earlier application.

The cation M employed is preferably sodium. However, the same can also be totally or partially replaced by other cations exchangeable with calcium, such as hydrogen, lithium, potassium, ammonium or magnesium, as well as by the cations of water-soluble organic bases, for example, by those of primary, secondary or tertiary alkylamines or alkylolamines with not more than 2 carbon atoms per alkyl radical, or not more than 3 carbon atoms per alkylol radical.

This process is indicated as being further improved in that the removal of soil is considerably improved when another compound is employed in the liquor which has a sequestering and/or precipitating effect on the calcium which is contained in the water as a hardening substance. Disclosed as suitable as sequestering agents for calcium were also substances with such a low sequestering power that they were not considered heretofore as sequestering agents for calcium. However, these compounds frequently have the capacity of delaying the precipitation of calcium carbonate from aqueous solutions.

Preferably, amounts of sequestering or precipitating agents of, for example, 0.05 to 2 gm/l, were added to accelerate or improve the removal of dirt. Preferred are amounts of 0.1 to 1 gm/l. Substantially larger amounts can also be used, but if phosphorus-containing sequestering or precipitating agents were used, their amount had to be so selected that the phosphorus load of the sewage was much less than with the presently used triphosphate-based detergents.

Copending, commonly-assigned U.S. patent application Ser. No. 458,326, filed Apr. 5, 1974, now abandoned, and its continuation Ser. No. 723,728, filed Sept. 16, 1976, now U.S. Pat. No. 4,083,793 disclose an improvement in the above invention, consisting of the presence, in the aqueous liquor together with said aluminosilicates of from 1 part by weight of nonionic surface-active compounds and from 0 to 3 parts by weight of anionic surface-active compounds, as said surface-active compound, said nonionic surface-active compounds being a mixture of a compound having a labile hydrogen and from 8 to 18 carbon atoms ethoxylated with from 8 to 20 ethylene oxide units and a compound having a labile hydrogen and from 8 to 18 carbon atoms ethoxylated with from 2 to 6 ethylene oxide units in a weight ratio of 1:0.2 to 2. An improved soil removal, particularly in the case of fatty and oily soils, is achieved by the combination of the aluminosilicates with the above-described tenside component.

OBJECTS OF THE INVENTION

An object of the present invention is the development of a process of treating soiled textiles by contacting soiled textiles with an aqueous liquor containing at least two compounds inhibiting alkaline earth metal ion precipitation on said soiled textiles as well as optionally at least one surface-active compound for a time sufficient to disperse or dissolve the soil from said soiled textiles into said aqueous liquor, separating said aqueous liquor and recovering said textiles substantially soil-free, comprising using (1) from 0.2 to 10 gm of anhydrous active substance per liter of at least one finely-dispersed, water-insoluble silicate compound containing at least some combined water and having a calcium binding power of at least 50 mg CaO/gm of anhydrous active substance and the formula on the anhydrous basis $$(M_{2/n}O)_x.Me_2O_3.(SiO_2)_y$$

where M is a cation of the valence n, exchangeable with calcium, x is a number of from 0.7 to 1.5, Me is a member selected from the group consisting of aluminum and boron, and y is a number from 0.8 to 6, and (2) from 0.05 to 2 gm per liter of at least one water-soluble compound selected from the group consisting of the free acid and acid salts of cations exchangeable with calcium of the following acids:

(A) An azacycloalkane-2,2-diphosphonic acid having the formula

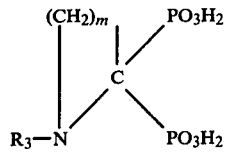

wherein m is an integer from 3 to 5 and $R_3$ is selected from the group consisting of hydrogen and alkyl having 1 to 3 carbon atoms, (B) A cyclic aminophosphonic acid having the formula

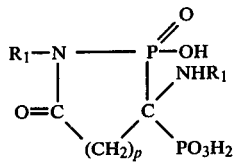

wherein p is an integer from 1 to 3 and $R_1$ is selected from the group consisting of hydrogen and alkyl having 1 to 6 carbon atoms, (C) Pyrrolidone-5,5-diphosphonic acid and N-alkylpyrrolidone-5,5-diphosphonic acid where alkyl has from 1 to 6 carbon atoms, (D) 3-amino-1-hydroxypropane-1,1-diphosphonic acid, and (E) A polyphosphonic acid having the formula

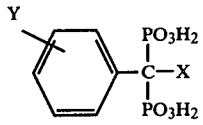

wherein X is a member selected from the group consisting of OH and $NH_2$ and Y is a member selected from the group consisting of hydrogen and halogen, preferably with the proviso that when X is $NH_2$, Y is halogen.

A further object of the present invention is the development of a detergent system for washing soiled textiles comprising the above water-insoluble silicate compound, the above water-soluble compounds, and a low to zero phosphate textile detergent.

These and other objects of the invention will become more apparent as the description thereof proceeds.

DESCRIPTION OF THE INVENTION

As described in Ser. No. 458,306 soil removal is improved considerably when a substance is added to the liquor that has a complexing and/or precipitating effect on the calcium ions present as a hardening constituent in the water. It has now been found that a series of such compounds are especially suitable for use in the process.

Thus, the present invention relates to an improved process for the washing and bleaching of textiles by treatment of the same with an aqueous liquor containing substances able to sequester the compounds that make the water hard, where finely dispersed, water-insoluble silicate compounds containing at least some combined water and having a calcium binding power of at least 50 mg CaO/gm of anhydrous active substance and the formula (I) on the anhydrous basis $$(M_{2/n}O)_x \cdot Me_2O_3 \cdot (SiO_2)_y \quad (I)$$

where M is a cation of the valence n, exchangeable with calcium, x is a number from 0.7 to 1.5, Me is aluminum or boron, and y is a number from 0.8 to 6, preferably from 1.3 to 4, suspended therein, as well as an organic calcium-complexing or precipitating builder, and where the aqueous liquor also optionally contains a surface-active compound, characterized in that one of the following compounds, capable of binding calcium, is present as a builder in the form of free acid or as a water-soluble salt thereof:

A. An azacycloalkane-2,2-diphosphonic acid of the formula

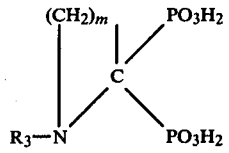

where m stands for 3 to 5 and R for a hydrogen or an alkyl with 1 to 3 carbon atoms;

B. A cyclic aminophosphonic acid of the general formula II

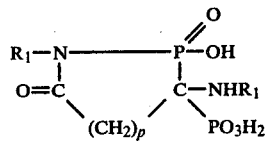

(II)

where R stands for an alkyl with 1 to 6 carbon atoms or a hydrogen atom and p for a number from 1 to 3;

C. Pyrrolidon-5,5-diphosphonic acid in which the hydrogen on the nitrogen may be replaced by an alkyl with 1 to 6 carbon atoms;

D. 3-Amino-1-hydroxypropane-1,1-diphosphonic acid;

E. A polyphosphonic acid of the general formula III

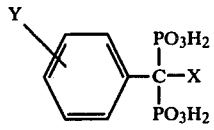

(III)

where x stands for OH and $NH_2$ and Y for H or halogen, where, when X is $NH_2$, Y is halogen.

All compounds of A to E are water-soluble and/or capable of forming water-soluble salts.

More particularly, the present invention is directed to a process of treating soiled textiles by contacting soiled textiles with an aqueous liquor containing at least two compounds inhibiting alkaline earth metal ion precipitation on said soiled textiles as well as optionally at least one surface-active compound for a time sufficient to disperse or dissolve the soil from said soiled textiles into said aqueous liquor, separating said aqueous liquor and recovering said textiles substantially soil-free, comprising using (1) from 0.2 to 10 gm of anhydrous active substance per liter of at least one finely-dispersed, water-insoluble silicate compound containing at least some combined water and having a calcium binding power of at least 50 mg CaO/gm of anhydrous active substance and the formula on the anhydrous basis $$(M_{2/n}O)_x.Me_2O_3.(SiO_2)_y$$

where M is a cation of the valence n, exchangeable with calcium, x is a number of from 0.7 to 1.5, Me is a member selected from the group consisting of aluminum and boron, and y is a number from 0.8 to 6, and (2) from 0.05 to 2 gm per liter of at least one water-soluble compound selected from the group consisting of the free acid and acid salts of cations exchangeable with calcium of the following acids:

(A) An azacycloalkane-2,2-diphosphonic acid having the formula

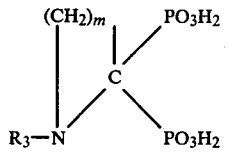

wherein m is an integer from 3 to 5 and $R_3$ is selected from the group consisting of hydrogen and alkyl having 1 to 3 carbon atoms, (B) A cyclic aminophosphonic acid having the formula

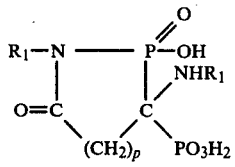

wherein p is an integer from 1 to 3 and $R_1$ is selected from the group consisting of hydrogen and alkyl having 1 to 6 carbon atoms.

(C) Pyrrolidone-5,5-diphosphonic acid and N-alkylpyrrolidone-5,5-diphosphonic acid where alkyl has from 1 to 6 carbon atoms.

D. 3-amino-1-hydroxypropane-1,1-diphosphonic acid,

E. A polyphosphonic acid having the formula

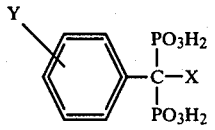

wherein X is a member selected from the group consisting of OH and $NH_2$ and Y is a member selected from the group consisting of hydrogen and halogen, preferably with the proviso that when X is $NH_2$, Y is halogen.

The azacycloalkane-2,2-diphosphonic acids of the above formula are described in the copending, commonly-assigned U.S. patent application Ser. No. 499,000, filed Aug. 20, 1974, now U.S. Pat. No. 3,941,772.

These compounds can be prepared by reacting lactams corresponding to the given formula, but containing a carbonyl group instead of the diphosphonomethylene group, with phosphorus trihalides or phosphorous acid and phosphorus trihalides, hydrolyzing the reaction product and optionally converting into a water-soluble salt. Examples for this group of compounds are: azacycloheptane-2,2-diphosphonic acid, azacyclopentane-2,2-diphosphonic acid, N-methylazacyclopentane-2,2-diphosphonic acid and azacyclohexane-2,2-diphosphonic acid.

The cyclic aminophosphonic acids of the general formula II are described in the copending, commonly-assigned U.S. patent application Ser. No. 498,996 filed Aug. 20, 1974, now U.S. Pat. No. 3,925,456.

These compounds can be prepared according to the process described therein, where dicarboxylic acid derivatives of the formula $X—(CH_2)_p—X$, where p is from 1 to 4 and X is CN, $COONH_2$ or COONHR (R=alkyl with 1 to 4 carbon atoms), are reacted with phosphorus trihalides or with phosphorous acid and phosphorus trihalides, the reaction product is hydrolyzed in an acid medium, and converted into a water-soluble salt, if desired. The reaction of the dicarboxylic acid derivatives with the phosphorus compounds is performed usually at a ratio of 1:2 to 1:6, preferably at approximately 1:4. Individual examples of this class of compounds are 2-hydroxy-2,7-dioxo-3-amino-3-phosphonyl-1,2-azaphosphacycloheptane; 2-hydroxy-2-oxo-3-amino-3-phosphonyl-5-oxo-1,2-azaphosphacycloheptane; 2-hydroxy-2-oxo-3-amino-3-phosphonyl-6-oxo-1,2-azaphosphacyclohexane; 1-methyl-2-hydroxy-2-oxo-3-methylamino-3-phosphonyl-6-oxo-1,2-azaphosphocyclohexane; 1-ethyl-2-hydroxy-2-oxo-3-ethylamino-3-phosphonyl-6-oxo-1,2-azaphosphacyclohexane; 1-butyl-2-hydroxy-2-oxo-3-butylamino-3-phosphonyl-6-oxo-1,2-azaphosphacyclohexane and 1-methyl-2-hydroxy-2-oxo-3-methylamino-3-phosphonyl-7-oxo-1,2-azaphosphacycloheptane.

The pyrrolidone-5,5-diphosphonic acid as well as its derivatives having a lower alkyl substituted on the nitrogen are described in the copending, commonly-assigned U.S. patent application Ser. No. 498,997, filed Aug. 20, 1974, now U.S. Pat. No. 3,960,888.

These compounds can be prepared, for example, by reacting succinic acid derivatives such as succinic acid diamide, which has, if desired, a lower alkyl with 1 to 7 carbon atoms on each amide group, with phosphorus trihalides or phosphorous acid and phosphorus trihalides, and subsequent alkaline hydrolysis of the reaction product. Particularly suitable in addition to succinic acid diamide are the dimethylamide, di-ethylamide, di-propylamide and di-butylamide derivatives.

All builder compounds used according to the present invention are solids in the anhydrous form. However, in practice they are employed either with a certain moisture content or in aqueous solution. The given amounts refer to the anhydrous compounds.

The compounds A to E are generally employed in ionized form in aqueous solution. They are used mainly in the form of their water-soluble salts. The cation ions employed are watersoluble cations exchangeable with calcium, preferably the cations of the alkali metals, particularly of sodium and potassium, but also of ammonium and/or organic ammonium derivatives. The water-soluble organic base cations which are suitable are, for example, those derived from primary, secondary or tertiary alkylamines or alkylolamines with not more than 2 carbon atoms per alkyl or not more than 3 carbon atoms per alkylol.

The use of the compounds enumerated above as complex-forming substances in the processes or in the compositions of the invention is of particular importance for products containing little or no phosphates. Exceptionally good phosphate-free detergents and cleaning substances can be prepared according to the invention. As far as these still include phosphate-containing compounds, their phosphate content is considerably reduced in comparison to the previously used phosphate-containing detergents. The invention thus offers a contribution to the solution of the so-called phosphate problem caused by the overabundance of phosphate, particularly in standing bodies of water.

The substances according to the invention contain preferably at least one surface-active compound or tenside. The composition of typical textile detergents, usable at temperatures of from 50° to 100° C., is within the range of the following recipe:

- 5% to 40%, particularly 5% to 30% by weight of anionic and/or nonionic and/or amphoteric surface-active compounds,
- 5% to 70% by weight of the above aluminosilicates,
- 2% to 45% by weight of the calcium-binding compounds used according to the invention,
- 0 to 50% by weight of wash alkalis that cannot form complexes (alkaline builders),
- 0 to 50% by weight of bleaching agents, as well as other adjuvants, present in most textile detergents in smaller quantities.

The above-defined aluminosilicates can be produced synthetically in a simple manner, for example, by reacting water-soluble silicates with water-soluble aluminates in the presence of water. To this end aqueous solutions of the starting materials can be mixed with each other, or one component which is present in solid form can be reacted with another component which is present as an aqueous solution. The desired aluminosilicates can also be obtained by mixing both solid components in the presence of water, preferably with comminution of the mixture. Aluminosilicates can also be produced from $Al(OH)_3$, $Al_2O_3$ or $SiO_2$ by reaction with alkali metal silicate or alkali metal aluminate solutions. Finally, such substances are also formed from the melt, but this method seems of less economical interest because of the required high melting temperature and the necessity of transforming the melt into finely-dispersed products.

The cation-exchanging aluminosilicates to be used according to the invention are only formed if special precipitation conditions are maintained, otherwise products are formed which have no, or an inadequate, calcium exchanging power. The calcium exchanging power of at least 50 mg CaO/gm of anhydrous active substance (AS) is critical to the present process. If aluminosilicates are employed with below the critical limit of calcium exchanging power, very little if any soil removal from the soiled textiles is effected.

The aluminosilicates in aqueous suspension produced by precipitation or by transformation in finely-dispersed form according to other methods are obtained in an X-ray amorphous form. They can be transformed from the amorphous into the aged or crystalline state by heating the suspension in water to temperatures of 50° to 200° C. However, there is hardly any difference between these two forms as far as the calcium binding power is concerned. Aside from the drying conditions, the calcium binding power of the aluminosilicates is proportional to the amount of aluminum contained therein with reference to the amount of silicon. Nevertheless, the crystalline aluminosilicates are preferred for the purpose of the invention. The preferred calcium binding power, which is in the range of 100 to 200 mg CaO/gm As, is found primarily in compounds of the composition:

$$0.7 \text{ to } 1.1Na_2O.Al_2O_3.1.3 \text{ to } 3.3SiO_2$$

This summation formula comprises two types of different crystal structures (or their non-crystalline initial products) which also differ by their summation formulas. These are:

(a) $0.7 \text{ to } 1.1Na_2O.Al_2O_3.1.3 \text{ to } 2.4SiO_2$ (b) $0.7 \text{ to } 1.1Na_2O.Al_2O_3.>2.4 \text{ to } 3.3SiO_2$ The different crystal structures can be seen in the X-ray diffraction diagram. The d-values found are given in the examples in the description of the production of the aluminosilicates I and II.

The amporphous or crystalline aluminosilicate contained in the aqueous suspension can be separated by filtration from the remaining aqueous solution and be dried at temperatures of 50° amorphous to 400° C., for example. Depending on the drying conditions, the product contains more or less combined water. Anhydrous products are obtained by drying at 800° C. If it is desired to remove the water completely, this can be done by heating for 1 hour to 800° C. This is the way the AS contents of the aluminosilicates are also determined.

Such high drying temperatures are not recommended for the aluminosilicates to be used according to the invention, preferably the temperature should not exceed 400° C. It is of particular advantage that even products dried at substantially lower temperatures of 80° to 200° C., for example, until the adhering liquid water is removed, can be used for the purposes of the invention. The aluminosilicates thus produced, which contain varying amounts of combined water, are obtained after the disintegration of the dried filter cake, as fine powders whose primary particle size does not exceed 0.1 mm, but is mostly lower and ranges down to dust fineness, for example, to 0.1 $\mu$. It must be kept in mind that the primary particles can be agglomerated to larger structures. In some production methods primary particle sizes ranging from 30 to 1 $\mu$ are obtained.

Of particular advantage are aluminosilicates having at least 80% by weight of particles of 10 to 0.01 $\mu$, preferably 8 to 0.1 $\mu$. These aluminosilicates preferably contain no primary or secondary particles above 30 $\mu$. As far as the products are crystalline, they are "microcrystalline".

The formation of smaller particle sizes can already be enhanced by the precipitation conditions. For these smaller particle sizes, the intermixed aluminate and silicate solutions, which can also be introduced simultaneously into the reaction vessel, are subjected to great shearing forces. If crystalline aluminosilicates are produced, which are preferred according to the invention, the formation of larger or inter-penetrating crystals is prevented by slowly stirring the crystallizing mass.

Nevertheless, undesired agglomeration of crystal particles can occur during the drying, so that it is advisable to remove these secondary particles in a suitable manner, for example, by air sifting. Aluminosilicates obtained in coarser form, which are ground to the desired particle size, can also be used. Suitable for this purpose are, for example, mills and/or air sifters or combinations thereof. The latter are described, for example, in Ullmann, "Enzyklopadie der technischen Chemie" Vol. 1, 1951, p. 632 to 634.

A considerable improvement in the products, i.e. the washing result with the compounds used according to the invention is achieved by the use of aluminosilicates with lower calcium-binding capacity.

It is also advantageous for the purposes according to the invention to utilize products that are still moist immediately after their precipitation or even in suspension (without intermediate drying), such as (a) a still flowing suspension of aluminosilicate in the liquor in which it is present at the end of the process of preparation, (b) an aluminosilicate from which the mother liquor was partially removed, (c) a still flowing suspension of aluminosilicate in water, obtained after partial or complete rinsing out of the mother liquor, or (d) an aluminosilicate from which the rinse water was partially removed.

What has been said about the primary particles applies to aluminosilicates that are still moist, in suspension or in the form of a slurry.

From the sodium aluminosilicates, aluminosilicates of other cations, for example, those of potassium, magnesium or water-soluble organic gases can be produced in a simple manner by the exchange of bases. The use of these compounds instead of the sodium aluminosilicates may be of advantage if a special effect is to be achieved by the supply of the said cations, for example, if the state of dissolution of different surface-active compounds simultaneously present in the composition is to be influenced.

These prepared aluminosilicates, that is, produced prior to their use, are used for the purposes of invention.

The amount of aluminosilicate required to achieve a good washing effect depends, on the one hand, on its calcium binding power, and on the other hand, on the amount and the type of soil of the textiles to be treated, and on the amount and hardness of the water used. If hard water is used, it is advisable to select the amount of aluminosilicate so that the residual hardness of the water does not exceed 5° dH (corresponding to 50 mg CaO/l), preferably 0.5° to 2° dH (corresponding to 5 to 20 mg CaO/l). In order to obtain an optimum washing effect, it is advisable, particularly for greatly soiled textiles, to use a certain excess of aluminosilicate, in order to bind completely or partially the hardening constituents contained in the released soil. The concentration of the aluminosilicates can thus be in the range from 0.2 to 10 gm As/l, preferably 1 to 6 gm As/l.

Preferably, smaller amounts of the sequestering agents of the invention, for example, 0.05 to 2 gm/l, are employed to noticeably accelerate or improve the removal of dirt. Preferred are amounts of 0.1 to 1 gm/l. Substantially larger amounts can also be used, but if phosphorus-containing sequestering or precipitating agents are used, their amount should be so selected that the phosphorus load of the sewage is much less than with the presently used triphosphate-based detergents. The amount of the aluminosilicates employed in the wash liquor can be reduced correspondingly with the use of larger amounts of the compounds according to the invention.

The use of the above-described aluminosilicates together with the sequestering compounds according to the invention makes it possible to keep the phosphorus content of the wash liquor to not more than 0.6 gm/l, preferably to not more than 0.3 gm/l, of organically and/or inorganically bound phosphorus, with the use of compounds containing phosphorus.

The process according to the invention operating with the use of synthetic, preferably crystalline aluminosilicates, is suitable for the washing, rinsing and bleaching of textiles of all types in the industry in commercial washing establishments and in the household.

The textiles to be washed can consist of various fibers of natural or synthetic origin. These include cotton, regenerated cellulose or linen, as well as textiles which contain highly processed cotton or synthetic chemical fibers, like polyamide, polyester, polyacrylonitrile, polyurethane, polyvinyl chloride or polyvinylidene chloride fibers. The detergents according to the invention can also be used for washing synthetic fiber-cotton blends called "wash and wear", occasionally also "no-iron" fabrics.

When washing by using cleaning liquors containing aluminosilicates in aqueous suspension, the washing or cleaning can be improved by common ingredients of these wash liquors. These include, for example, surface-active compounds, surface-active or non-surface-active form stabilizers or inhibitors, textile softeners, neutral or alkaline-reacting builder salts, chemical bleaches, as well as stabilizers and/or activators for the latter, soil suspension agents, corrosion-inhibitors, antimicrobial substances, enzymes, brighteners, dyes and perfumes.

When using one or several of the above-mentioned substances, normally contained in wash liquors, the following concentrations are preferably maintained:

0 to 2.5 gm/l of surface-active compounds 0 to 0.4 gm/l of activated oxygen or equivalent amounts of activated chlorine as a bleach.

The terms "activated oxygen" and "activated chlorine" are employed as meaning bleaching compounds with an oxygen-oxygen bond or a chlorine content, with the given amounts referring to the active oxygen or chlorine, respectively.

The pH-value of the liquors can be between 6 and 13, preferably between 8.5 and 12, depending on the type of textile to be washed.

For a long time, attempts have been made to find a suitable substitute for phosphates which can not only bind calcium but which are also biodegradable in sewage. Various organic compounds have, therefore, been suggested as phosphate substitutes. The technical teaching of the invention of using for this purpose water-insoluble cation-exchanging aluminosilicates together with the complexing agents of the inventon is therefore a complete abandonment of the general direction in which the industry ha worked. It is particularly surprising that the water-insoluble aluminosilicates used in the invention are completely washed out from the fabrics. The use of the aluminosilicates means a relief of the sewage in two respects. The amounts of phosphorus arriving in the sewage are greaty reduced or completely eliminated, and the aluminosilicates require less oxygen for biological degradation. They are of a mineral nature, settle gradually in the clarifying plants or in natural waters and thus meet the ideal requisites of a phosphate substitute.

But they are also superior to other suggested phosphate substitutes in their washing action. In particular, they absorb colored soil, and thus save on chemical bleaches.

Baths to be used for textiles according to the invention are prepared by the addition of the substances according to the invention to water. Data for the proportionate amounts and the nature of the compounds present in the baths also apply to the substances according to the invention, therefore.

The amount of substances of phosphonic acid type, present in the materials according to the invention, is preferably not greater than that which corresponds to a total phosphorus content of 6% in the material, preferably 3%. These amounts are percents by weight. Basically, they refer to anhydrous substances, unless otherwise noted.

The calcium complexing, binding and/or precipitating compounds used according to the invention are present in the materials according to the invention preferably in amounts of 2% to 15%. However, they can be used in smaller amounts of as low as 1%, or in larger amounts of as much as 15% to 30%.

The broad range in detergent compositions is therefore from 1% to 45% by weight. The weight ratio of the substances used according to the invention to the aluminosilicates of Formula I is frequently approx. 1:8 to 2:1.

The aluminosilicate content of such detergent materials can be in the range of from 2% to 95% by weight, generally between 5% and 95% by weight, with relatively low aluminosilicate contents of from 5% to 15% by weight or relatively high contents of from 15% to 60% by weight being preferable, depending on the type and amount of the compounds used according to the invention.

The preferable surface-active compounds or tensides are the tenside combinations in which compounds with low and high ethoxylation are used optionally, in combination with anionic tensides. The nonionic tensides (nonionics), to be used accordingly, are addition products of 2 to 6 or 8 to 18 mols of ethylene oxide to 1 mol of a fatty alcohol, alkylphenol, fatty acid, fatty amine, fatty acid amine or alkanesulfonamide, where the fatty moiety is a higher fatty moiety having from 8 to 20 carbon atoms and alkyl has from 6 to 18 carbon atoms. Particularly important are the purely aliphatic nonionics, derived from coconut or tallow fatty alcohols, oleyl alcohol or secondary alkanols with 8 to 18, preferably 12 to 18 carbon atoms.

Also useable as nonionics are the addition products of ethylene oxide and terminal or non-terminal vicinal alkanediols having from 8 to 20 carbon atoms, preferably those with 2 to 4 and 8 to 12 ethylene glycol units, respectively, in the molecule.

Also present in the detergents according to the invention may be organic sulfonic acids, carboxylic acids and sulfocarboxylic acids that are not surface-active and contain 1 to 8 carbon atoms. These are, for example, water-soluble salts of benzene sulfonic acid, toluene sulfonic acid or xylene sulfonic acid, water-soluble salts of sulfoacetic acid, sulfobenzoic acid or of sulfodicarboxylic acids.

Wash alkalis are also utilized in the process according to the invention or in the detergents according to the invention. Usually, these amount approximately to 2% to 35% by weight of the total. Particularly the alkali metal, preferably sodium, carbonates, dicarbonates, borates and silicates are included under the term "wash alkalis". Particularly important wash alkalis are sodium carbonate and sodium silicate, which are frequently used in combination. The alkali metal silicates usually have ratios of $SiO_2$:$Na_2O$ in the range of 0.66:1 to 4:1, ratios between 2.3:1 and 3.45:1 being generally preferred. The preferred $SiO_2$:$Na_2O$ ratio for a given case also depends on the desired degree of the contribution of the alkali metal silicate toward the alkalinity of the detergent or bath liquor. Thus it is possible that ratios between 1:1 and 2.3:1 can e especially desirable, also.

The other materials used according to the invention and for the tensides, foam inhibitors, foam stabilizers, bleaches and stabilizers suitable for the process according to the invention and/or activators for these, as well as soil carriers, enzymes and brighteners, are further described in the previously filed applications Ser. No. 458,306 and 458,326, wherein the above-mentioned classes of compounds were discussed in detail.

Of particular practical interest are the materials according to the invention that are powdered or granular and can be prepared according to all known technological processes. The use of the compounds of formula I in the form of agglomerates can be advantageous to facilitate the finishing and handling of the products. It is generally desirable if these agglomerates break down, e.g. with reversion into the primary particles, during use. The aluminosilicates in powder form, for example, can be mixed with the other components of the detergents in a very simple manner, by spraying oily or paste-like products such as nonionics on the powder. Another manner of preparation is the working of the powdered aluminosilicates into the other components of the material, which are in the form of an aqueous paste that is then turned into powder by crystallization processes or by drying the water with heat. After drying in hot air, e.g. on belts or in spray-drying ovens, substances that are sensitive to heat and moisture such as bleach components and activators for these, enzymes, antimicrobial agents, etc. can be mixed in.

The composition of typical textile washing agents to be used in the temperature range of 50° to 100° C. fall in the range of the following recipe:

- 5% to 30% of anionic and/or non-ionic and/or amphoteric surface-active compounds,
- 5% to 70% of aluminosilicates (related to AS),
- 2% to 45% of the sequestering agents for calcium according to the invention,
- 0 to 50% of wash alkalies not capable of sequestration (alkaline builder salts),
- 0 to 50% of bleaches as well as other additives mostly contained in detergents in small quantities.

The surface-active compounds or tensides contain in the molecule at least one hydrophobic organic moiety and one water-solubilizing, anionic, non-ionic or amphoteric group. The hydrophobic moiety is mostly an aliphatic hydrocarbon radical with 8 to 26, preferably 10 to 22 and particularly 12 to 18 carbon atoms or an alkyl aromatic radical, such as alkylphenyl, with 6 to 18, preferably 8 to 16 aliphatic carbon atoms.

Among the anionic surface-active compounds are, for example, soaps of natural or synthetic, preferably saturated fatty acids, optionally, also, soaps of resinic or naphthenic acids. Suitable synthetic anionic tensides are those of the type of the sulfonates, sulfates and synthetic carboxylates.

Suitable anionic tensides of the sulfonate type are alkylbenzene sulfonates ($C_{9-15}$ alkyl) mixtures of alkenesulfonates and hydroxyalkanesulfonates, as well as alkanedisulfonates, as they are obtained, for example, from monoolefins with terminal or non-terminal double bonds by sulfonation with gaseous sulfur trioxide and subsequent alkaline or acid hydrolysis of the sulfonation products. Also suitable are alkanesulfonates which are obtained form alkanes by sulfochlorination or sulfoxidation and subsequent hydrolyisis or neutralization or by bisulfite addition to olefins. Other suitable tensides of the sulfonate type are the esters of α-sulfofatty acids, for example, the α-sulfonic acids of hydrogenated methyl or ethyl esters of coconut, palmkernel or tallow fatty acids.

Suitable tensides of the sulfate type are the sulfuric acid monoesters of primary alcohols (e.g. from coconut fatty alcohols, tallow fatty alcohols or oleyl alcohol) and those of secondary alcohols. Also suitable are sulfated fatty acid alkanolamides, sulfated fatty acids monoglycerides or sulfated reaction products of 1 to 4 mols of ethylene oxide with primary or secondary fatty alcohols or alkylphenols.

Other suitable anionic tensides are the fatty acid esters or amides of hydroxy- or amino-carboxylic acids or sulfonic acids, such as the fatty acid sarcosides, fatty acid glycolates, fatty acid lactates, fatty acid taurides or fatty acid isoethionates.

The anionic tensides can be present in the form of their alkali metal salts, such as the sodium or potassium salts, the ammonium salts, as well as soluble salts of organic bases, such as the lower alkylolamines, for example, mono-, di- or triethanol amine.

Suitable non-ionic surface-active compounds or tensides are the addition products of 4 to 40, preferably 4 to 20 moles of ethylene oxide to 1 mol of a fatty alcohol, alkylphenol, fatty acid, fatty amine, fatty acid amide or alkanesulfonamide. Particularly important are the addition products of 5 to 16 mols of ethylene oxide to coconut fatty alcohols or tallow fatty alcohols, to oleyl alcohol or to secondary alkanols with 8 to 18, preferably 12 to 18 carbon atoms, as well as monoalkylphenols or dialkylphenols with 6 to 14 carbon atoms in the alkyls. In addition to these water-soluble non-ionics, polyglycol ethers with 1 to 4 ethylene glycol ether radicals in the molecule, which are insoluble or not completely water-soluble, are also of interest, particularly if they are used together with water-soluble non-ionic or anionic tensides.

Furthermore, the water-soluble addition products of 20 to 250 mols of ethylene-oxide to polyoxypropylene glycol containing 10 to 100 propylene glycol ether groups (Pluronics®), to alkylenediamine-polyoxypropylene glycol (Tetronics®), and to alkylpolyoxypropylene glycols with 1 to 10 carbon atoms in the alkyl chain, can also be used where the polyoxypropylene glycol chain acts as a hydrophobic radical.

Non-ionic tensides of the type of the amine oxides or sulfoxides can also be used.

The foaming power of the tenside can be increased or reduced by combination of suitable tenside types. A reduction can also be achieved by additions of non-surface-active organic substances.

Suitable foam stabilizers, particularly in tensides of the sulfonate or sulfate type, are surface-active carboxy or sulfobetaines, as well as the above-named non-ionics of the alkylolamide type. Moreover, fatty alcohols or higher terminal diols have been suggested for this purpose.

A reduced foaming power, that is desirable for the use in washing machines, is often attained by combination of different tenside types, such as of sulfates and/or sulfonates with nonionics, and/or with soaps. In soaps, the foam inhibition increases with the degree of saturation and the number of carbons in the fatty acid residue. Soaps derived from saturated $C_{20-24}$ fatty acids have been proven good as foam inhibitors.

The non-tenside foam inhibitors included N-alkylated aminotriazines, optionally containing chlorine, which are obtained by the reaction of 1 mol of cyanuric acid chloride with 2 to 3 mols of a mono- and/or dialkylamine with 6 to 20, preferably 8 to 18 carbon atoms in the alkyl radicals. Similarly effective are propoxylated and/or butoxylated aminotriazines such as, products that are obtained by the addition of from 5 to 10 mols of propylene oxide to 1 mol of melamine and further addition of from 10 to 50 mols of butylene oxide to this propylene-oxide derivative.

Likewise suitable as non-tenside foam inhibitors are water-insoluble organic compounds, like paraffins, or halogenated paraffins with melting points below 100° C., aliphatic $C_{18}$ to $C_{40}$ ketones, as well as aliphatic carboxylic acid esters which contain in the acid or alcohol residue, optionally, also in both of these residues, at least 18 carbon atoms (such as triglycerides or fatty acid/fatty alcohol esters). These compounds can be used to reduce foaming, particularly in combinations of tensides of the sulfate and/or sulfonate type with soaps.

Particularly low-foaming non-ionics, which can be used either alone or in combination with anionic, amphoteric and non-ionic tensides, and which reduce the foaming power of high-foaming tensides, are the addition products of propylene oxide on the above-described surface-active polyoxyethyleneglycol ethers as well as the likewise-described addition products of ethylene oxide to polyoxypropylene glycols and to alkylenediamine polyoxypropylene glycols or to alkyl polyoxypropylene glycols having 1 to 10 carbons in the alkyl.

Weakly acid, neutral or alkaline-reacting inorganic or organic salts can be used as builder salts.

Suitable weakly acid, neutral or alkaline-reacting salts for use according to the invention are, for example, the bicarbonates, carbonates, borates or silicates of the alkali metals, alkali metal sulfates, as well as the alkali metal salts of organic, non-surface-active sulfonic acids, carboxylic acids and sulfocarboxylic acids containing from 1 to 8 carbon atoms. These include, for example, water-soluble salts of benzenesulfonic acid, toluenesulfonic acid or xylenesulfonic acid, water soluble salts of sulfoacetic acid, sulfobenzoic acid or of sulfodicarboxylic acids.

The compounds mentioned above as sequestering or precipitating agents for calcium are suitable as builder salts. They can, therefore, be present in the agents according to the invention in larger quantities than is necessary to perform their function as sequestering or precipitating compounds for calcium.

The individual components of the products used preferably as textile washing components, or as household cleaning compositions, particularly the builder salts, are mostly so selected that the preparations react neutral to strongly alkaline, so that the pH-value of a 1% solution of the preparation is mostly in the range of 7 to 12. Fine washing agents show mostly a neutral to weakly alkaline reaction (pH value = 7 to 9.5), while soaking agents, prewashing agents and boiling washing agents are more alkaline (pH value = 9.5 to 12, preferably 10 to 11.5). If higher pH-values are required for special cleaning purposes, these can be easily obtained by using alkali metal silicates of a suitable $Na_2O:SiO_2$ ratio or caustic alkalies.

Among the compounds serving as bleaching agents and releasing $H_2O_2$ in water, sodium perborate tetrahydrate ($NaBO_2.H_2O_3.3H_2O$) and the monohydrate ($NaBO_2.H_2O_2$) are of particular importance. But also other $H_2O_2$ releasing borates can also be used, such as perborate $Na_2B_4O_7.4H_2O$. These compounds can be replaced partly or completely by other carriers of active oxygen, particularly by peroxyhydrates, such as peroxycarbonates, ($Na_2CO_3.1.5H_2O_2$), peroxypyrophosphates, citrate perhydrates, urea-$H_2O_2$ compounds, as well as by $H_2O_2$-releasing peracid salts, such as Caroates ($KHSO_5$), perbenzoates or peroxyphthalates.

IT is recommended to incorporate water-soluble and/or water-insoluble stabilizers for the peroxy compounds together with latter in amounts of 0.25% to 10% by weight. Water-insoluble stabilizers, which amount to 1% to 8%, preferably 2% to 7% of the weight of the entire preparation are, for example, the magnesium silicates having $MgO:SiO_2$ ratio of 4:1 to 1:4, preferably 2:1 to 1:2, and particularly 1:1, which are mostly obtained by precipitation from aqueous solutions. In their place, other alkaline earth metal, cadmium or tin silicates of corresponding compositions are also useable. Also hydrous oxides of tin are suitable as stabilizers. Water-soluble stabilizers, which can be present together with water-insoluble stabilizers, are mostly the sequestering agents which can be added in amounts of 0.25% to 5%, preferably 0.5% to 2.5% of the weight of the entire preparation. In particular, these are the organic sequestering agents which show a pronounced complexing power for heavy metal ions, such as for example, the alkali metal salts of ethylenediaminetetraacetic acid, nitrilo-trimethylenephosphonic acid 1-hydroxyethane-1,1-diphosphonic acid.

In order to obtain a satisfactory bleaching effect then washing at temperatures below 80° C., particularly in the range of 60° to 40° C., activator-containing bleaching components are preferably incorporated in the preparations.

Certain N-acyl and/or O-acyl compounds forming, with $H_2O_2$, organic per acids serve as activators for per compounds releasing $H_2O_2$ in water. Particularly to be mentioned are acetyl, propionyl or benzoyl compounds, as well as carbonic acid or pyrocarbonic acid esters. Suitable compounds are among others: the N-diacylated and N,N'-tetraacylated amines, such as N,N,N',N'-tetraacetyl-methylenediamine, N,N,N',N'-tetraacetyl-ethylenediamine, N,N-diacetyl-aniline and N,N-diacetyl-p-toluidine, or the 1,3-diacylated hydantoins and alkyl-N-sulfonyl-carbonamides, such as N-methyl-N-mesyl-acetamide, N-methyl-N-mesyl-benzamide, N-methyl-N-mesyl-p-nitrobenzamide, and N-methyl-N-mesyl-p-methoxybenzamide, the N-acylated cyclic hydrazides, acylated triazoles or urazoles, such as monoacetyl maleic acid hydrazide, the O,N,N-trisubstituted hydroxylamines, such as O-benzoyl-N,N-succinyl-hydroxylamine, O-acetyl- N,N-succinyl-hydroxylamine, O-p-methoxybenzoyl-N,N-succinyl-hydroxylamine, O-p-nitrobenzoyl-N,N-succinyl-hydroxylamine and O,N,N-triacetylhydroxylamine, the N,N'-diacyl-sulfuryl amides, such as N,N'-dimethyl-N,N'-diacetyl-sulfurylamide, and N,N'-diethyl-N,N'-diethyl-N,N'-dipropionyl-sulfuryl amide, the triacyl cyanurates, such as triacetyl cyanurate or tribenzoyl cyanurate, the carboxylic acid anhydrides, such as benzoic acid anhydride, m-chlorobenzoic acid anhydride, phthalic acid anhydride, 4-chlorophthalic acid anhydride, the sugar esters, such as glucose pentaacetate, the 1,3-diacyl-4,5-diacyloxyimidazolidines, for example the compounds 1,3-diformyl-4,5-diacetoxy-imidazolidine, 1,3-diacetyl-4,5-diacetoxy-imidazolidine, 1,3-diacetyl-4,5-dipropionyloxy-imidazolidine, the acylated glycolurils, such as tetrapropionyl glycoluril or diacetyl-dibenzoyl glycoluril, the diacylated 2,5- diketopiperazines, such as 1,4-diacetyl-2,5-diketopiperazine, 1,4-dipropionyl-2,5-diketopiperazine, 1,4-dipropionyl-3,6-dimethyl-2,5-diketopiperazine, the acetylated or benzolylated products of propylenediurea or 2,2-dimethyl-propylene diurea [2,4,6,8-tetraazobicyclo-(3,3,1)-nonane-3,7-dione or its 9,9 dimethyl derivative], and the sodium salts of p-ethoxycarbonyloxy)-benzoic acid and p-(propoxycarbonyloxy)-benzene sulfonic acid.

The activated chlorine compounds serving as bleaching agents can be of an inorganic or organic nature.

The inorganic active chlorine compounds include alkaline metal hypochlorites, which can be used particularly in the form of their mixed salts or addition compounds with orthophosphates or on condensed phosphates such as with alkali metal pyrophosphates and polyphosphates, or with alkali metal silicates. If the washing agents and washing assistant compositions contain mono-persulfates and chlorides, active chlorine is formed in aqueous solution.

The organic active-chlorine compounds which can be used are particularly the N-chloro compounds, where one or two chlorine atoms are linked to a nitrogen atom, the third valence of the nitrogen atoms leading preferably to a negative group, particularly to a CO— or $SO_2$-group. These compounds include dichlorocyanuric acid and trichlorocyanuric acid or their salts, chlorinated alkylguanides or alkylbiguanides, chlorinated hydantoins and chlorinated melamines.

The preparations according to the invention can furthermore contain soil suspension agents or dirt carriers, which keep the dirt released from the fibers in suspension in the liquor and so prevent graying. Suitable compounds are water-soluble colloids, mostly of an organic nature, such as the water-soluble salts of polymeric carboxylic acids, glue, gelatin, salts of ether carboxylic acids or ether sulfonic acids of starch or cellulose, or salts of acid sulfuric acid esters of cellulose or starch. Water-soluble polyamides containing acid groups are also suitable for this purpose. Furthermore, soluble starch preparations and other than the above-mentioned starch products can be used, for example, degraded starches, aldehyde starches etc. Polyvinyl pyrrolidone can also be used.

The enzyme preparations to be used are mostly a mixture of enzymes with different effects, such as proteases, carbohydrases, esterases, lipases, oxidoreductases, catalases, peroxidases, ureases, isomerases, lyases, transferases, desmolases, or nucleases. Of particular interest are the enzymes, obtained from bacteria strains or from fungi, such as Bacillus subtilis or Streptomyces griseus, particularly proteases and amylases, which are relatively stable towards alkalis, percompounds, and anionic tensides and are still effective at temperatures up to 70° C.

Enzyme preparations are marketed by the manufacturers mostly as aqueous solutions of the active substances or as powders, granulates or as cold-sprayed products. They frequently contain sodium sulfate, sodium chloride, alkali metal ortho-, pyro- and polyphosphates, particularly tripolyphosphate, as fillers. Dust-free preparations are particularly valued. These are obtained in a known manner by incorporating of oily or pasty Nonionics or by granulation with the aid of melts of water-of-crystallization-containing salts in their own water-of-crystallization.

Enzymes may be incorporated which are specific for certain types of soil, for example, proteases or amylases or lipases. Preferably, combinations of enzymes with different effects are used, particularly combinations of proteases and amylases.

The washing agents can contain optical brighteners such as those for cotton, particularly derivatives of diaminostilbenedisulfonic acid or its alkali metal salts. Suitable are, for example, salts of 4,4'-bis-(2-anilino-4-morpholino-1,3,5-triazin-6-yl-amino)-stilbene-2,2'-disulfonic acid or similarly compounds which have instead of the morpholino group, a diethanolamino group, a methylamino group or a 2-methoxyethylamino group. Brighteners for polyamide fibers which can be used are those of the type of the 1,3-diaryl-2-pyrazolines, for example, the compound 1-(p-sulfamoylphenyl)-3-(p-chlorophenyl)-2-pyrazoline, as well as compounds of similar composition which have instead of the sulfamoyl group, for example, the methoxycarbonyl group, the 2-methoxyethoxycarbonyl group, the acetylamino group or the vinylsulfonyl group. Suitable polyamide brighteners are also the substituted aminocumarins, for example, 4-methyl-7-dimethylamino-cumarin or 4-methyl-7-diethylaminocumarin. Furthermore, the compounds 1-(2-benzimidazolyl)-2-(1-hydroxyethyl-2-benzimidazolyl)-ethylene and 1-ethyl-3-phenyl-7-diethylamino-carbostyril can also be used as polyamide brighteners. Brighteners for polyester and polyamide fibers which can be used are the compounds 2,5-di-(2-benzoxazolyl)-thiophene,2-(2-benzoxazolyl)-naphtho-[2,3-b]-thiophene and 1,2-di-(5-methyl-2-benzoxazolyl)-ethylene. Furthermore, brighteners of the type of the substituted 4,4'-distyryl-diphenyls can be utilized, for example, the compound 4,4'-bis-(4-chloro-3-sulfostyryl)-diphenyl. Mixtures of the above-mentioned brighteners can likewise be used.

The following specific embodiments are illustrative of the invention without being limitative in any respect.

EXAMPLES

First, the production of the finished aluminosilicates is described, for which no invention is claimed. Other aluminosilicates useful in the invention are described in the first filed Ser. No. 458,306.

PROCESS CONDITIONS

The aluminate solution, diluted with deionized water was mixed in a vessel of 15 liter capacity, under vigorous stirring with the silicate solution. Both solutions were at room temperature. An X-ray amorphous sodium aluminosilicate was formed in the exothermic reaction as a primary precipitation product. After stirring for 10 minutes, the suspension of the precipitation product was either separated as an amorphous product or transferred to a crystallization vessel where it remained for some time at the elevated temperature given to crystallize. After draining off the liquor from the crystals and washing with deionized water until the outflowing wash water had a pH-value of about 10, the filter residue was dried. When there is any deviation from this general production procedure, this is mentioned explicitly in the specific part. Thus, for example, in some cases for the practical tests, the homogenized uncrystallized suspension of the precipitation product or the crystal sludge was used. The water content was determined by heating the product for one hour to 800° C.

In the production of microcrystalline aluminosilicates, indicated by the suffix "m", the aluminate solution diluted with deionized water was mixed with the silicate solution and mixed in a high-speed intensive stirrer (10,000 rpm, "Ultraturrax", made by Janke & Kunkel IKA-Werk, Stauffen/Breisgan/Federal Republic of Germany). After vigorous stirring for 10 minutes, the suspension of the amorphous precipitation product was transferred to a crystallization vessel where the formation of large crystals was prevented by stirring the suspension. After draining off the liquor and washing with deionized water until the outflowing water had a pH value of about 10, the filter residue was dried, then ground in a ball mill and separated in a centrifugal sifter ("Microplex" air sifter, made by Alpine, Augsburg, Federal Republic of Germany) into two fractions, of which the finer fraction contained no portions above 10 $\mu$. The particle size distribution was determined by means of a sedimentation scale.

The degree of crystallization of an aluminosilicate can be determined from the intensity of the interference lines of an X-ray diffraction diagram of the respective product, compared to the corresponding diagrams of X-ray amorphous or fully crystallized products.

All data in % are in percent by weight.

The calcium binding power of the aluminosilicates or borosilicates was determined in the following manner. 1 liter of an aqueous solution, containing 0.594 gm of $CaCl_2$ (=300 mg CaO/l=30° dH) and adjusted to a pH of 10 with diluted NaOH, was mixed with 1 gm of the aluminosilicate or borosilicate (on the anhydrous basis, AS). Then the suspension was stirred vigorously for 15 minutes at a temperature of 22° C. (±2° C.). After filtering off the aluminosilicate, the residual hardness x of the filtrate was determined. From it, the calcium binding power was calculated in mg CaO/gm. As according to the formula: (30—x).10. For short hand purposes, the above procedure is hereinafter referred to by the Calcium Binding Power Test Method.

If calcium binding power is determined at higher temperature, for example, at 60° C., better values are obtained than at 22° C. This fact distinguishes the aluminosilicates from most of the soluble sequestering agents that have been suggested so far for use in detergents and represents a particular technical progress in their use.

| Production conditions for aluminosilicate I: | |
|---|---|
| Precipitation | 2.985 kg of an aluminate solution of the composition: 17.7% $Na_2O$, 15.8% $Al_2O_3$, 66.6% $H_2O$<br>0.15 kg of soidum hydroxide<br>9.420 kg of water<br>2.445 kg of a 25.8% sodium silicate solution of the composition 1 $Na_2O$. 6.0 $SiO_2$, prepared freshly from commercial waterglass and easily alkali-soluble silica |
| Crystallization: | 24 hours at 80° C. |
| Drying: | 24 hours at 100° C. |
| Composition: | 0.9 $Na_2O$ . 1 $Al_2O_3$ . 2.05 $SiO_2$ . 4.3 $H_2O$ (= 21.6% $H_2O$) |
| Degree of crystallization: | Fully crystalline |
| Calcium binding power: | 150 mg CaO/gm AS. |

If the product obtained was dried for 1 hour at 400° C., an aluminum silicate Ia was obtained of the composition:

$0.9Na_2O.1Al_2O_3.2.04SiO_20.2.0H_2O(=11.4\%\ H_2O)$ which is likewise suitable for the purposes of the invention.

| Product conditions for aluminosilicte II: | |
|---|---|
| Precipitation: | 2.115 kg of an aluminate solution of the composition: 17.7% $Na_2O$ 15.8% $Al_2O_3$, 66.5% $H_2O$<br>0.585 kg of sodium hydroxide<br>9.615 kg of water<br>2.685 kg of a 25.8% sodium silicate solution of the composition 1 $Na_2O$. 6 SiO hd 2 (prepared as under I) |
| Crystallization: | 24 hours at 80° C. |
| Drying: | 24 hours at 100° C. and 20 torr. |
| Composition: | 0.8 $Na_2O$ . 1 $Al_2O_3$ . 2.655 $SiO_2$ . 5.2 $H_2O$ |
| Degree of crystallization: | Fully crystalline |
| Calcium binding power: | 120 mg CaO/gm AS. |

This product too can be dehydrated by drying (for 1 hour at 400° C.) to the composition:

$0.8Na_2O.1Al_2O_3.2.65SiO_2.0.2H_2O$

This dehydration product IIa is likewise suitable for the purposes of the invention.

The aluminosilicates I and II show in the x-ray diffraction diagram the following interference lines.

| d- values, recorded with Cu-$K_\alpha$- radiation in A | |
|---|---|
| I | II |
| — | 14.4 |
| 12.4 | — |
| — | 8.8 |
| 8.6 | — |
| 7.0 | — |
| — | 4.4 (+) |
| 4.1 (+) | — |
| — | 3.8 (+) |
| 3.68 (+) | — |
| 3.38 (+) | — |
| 3.26 (+) | — |
| 2.96 (+) | — |
| — | 2.88 (+) |
| — | 2.79 (+) |
| 2.73 (+) | — |
| — | 2.66 (+) |
| 2.60 (+) | — |

It is quite possible that not all these interference lines will appear in the X-ray diffraction diagram, particularly if the aluminosilicates are not fully crystallized. For this reason, the d-values which are the most important for the characterization of these types are identified by a "(+)".

| Production conditions for aluminosilicate Im | |
|---|---|
| Precipitation: | 2.985 kg of an aluminate solution of the composition 17.7% $Na_2O$, 15.8% $Al_2O_3$, 66.6% $H_2O$<br>0.150 kg of sodium hydroxide<br>9.420 kg of water<br>2.445 kg of a 25.8% sodium silicate solution of the composition: 1 $Na_2O$ . 6 $SiO_2$ (prepared as in I) |
| Crystallization: | 6 hours at 90° C. |
| Drying: | 24 hours at 100° C. |
| Composition: | 0.9 $Na_2O$ . 1 $Al_2O_3$ . 2.04 $SiO_2$ . 4.3 $H_2O$ (= 21.6% $H_2O$) |
| Degree of Crystallization: | Completely crystalline |
| Calcium binding power: | 170 mg CaO/gm AS. |

The distribution of the particle size determined by sedimentation analysis was in the following range:

| | |
|---|---|
| > 40 μ = 0%<br>> 10 μ = 85% to 95%<br>< 8 μ = 50% to 95% | The maximum range of the particle size distribution curve was situated at 3 to 6 μ. |

The degree of crystallization of an aluminosilicate can be determined from the intensity of the interference lines of an x-ray diffraction diagram of each product in comparison with the respective diagrams of amorphous or completely crystallized products.

The salt constituents contained in the detergents of the examples, such as surfactants in salt form, other organic salts, as well as inorganic salts, were present as sodium salt, unless explicitly stated otherwise. This also applies to the precipitation inhibitors or chelating agents which are designated for simplicity's sake as the corresponding acids. The designations and abbreviations used have the following meaning:

ABS the salt of alkylbenzenesulfonic acid with 10 to 15, preferably 11 to 13 carbon atoms in the alkyl chain, obtained by condensation of straight-chain olefins with benzene and sulfonation of the alkylbenzene thus obtained.

Fs-Ester Sulfonate a sulfonate obtained by sulfonation with $SO_3$ of a methyl ester of a hardened tallow fatty acid.

Olefin Sulfonate a sulfonate, obtained by the sulfonation with $SO_3$ of mixtures of straight-chain, non-terminal olefins with 12 to 18 carbon atoms and hydrolyzation of the sulfonation product with caustic, which consists mainly of alkene sulfonate and hydroxy alkane sulfonate, but contains also small amounts of alkane disulfonates.

OA+xEO or TA+xEO the addition products of ethylene oxide (EO) to technical oleyl alcohol (OA) or to tallow fatty Azacycloheptane-2,2-diphosphonic acid or pyrrolidione-2,2-diphosphonic acid was used in the same amount and with the same effect instead of 2-hydroxy-2,7-dioxo-3-amino-3-phosphonyl-1,2-azaphosphacycloheptane. Also 1-hydroxy-p-chlorophenylmethane diphosphonic acid instead of 1-hydroxy-1-phenylmethane diphosphonic acid was employed in the same amount and with the same effect.

| Components | Example 5 |
|---|---|
| Soap $C_{12}$—$C_{22}$ | 2.0 |
| TA + 5 EO | 3.0 |
| TA + 14 EO | 7.0 |
| CMC | 1.5 |
| EDTA | 0.2 |
| Mg $SiO_3$ | 1.5 |
| Optical brightener | 0.25 |
| Perborate | 20.0 |
| Aluminosilicate | 15.0 |
| Sodium carbonate | 20.0 |
| Na-silicate | 15.0 |
| 1-chloro-1-phenylmethanediphosphonic acid | 8.0 |

-continued

| Components | Example 5 |
|---|---|
| Remainder $Na_2SO_4$ + $H_2O$ | |

alcohol (TA) (iodine number=0.5), where the values for x indicate the molar amount of ethylene oxide added to 1 mol of alcohol.

TA-Sulfonate the salt of a sulfated, mainly saturated fatty alcohol, produced by reduction of tallow fatty acid.

CMC the salt of carboxymethyl cellulose.

Perborate a product of the approximate composition $NaBO_2.H_2O_2.3H_2O$, containing approximately 10% active oxygen.

Foam Inhibitor an N-alkylated aminotriazine obtained by the reaction of cyanuric chloride with a mono- or dialkylamine with 8 to 18 carbon atoms in the alkyl.

Aluminosilicate a microcrystalline aluminosilicate Im prepared as described above, where the percentages refer to the proportion by weight of the anhydrous active substance (AS).

Na-Silicate a sodium silicate with a $SiO_2$:$Na_2O$ ratio of 3.35:1 by weight.

Soap $C_{12}$–$C_{22}$ or Soap $C_{16}$–$C_{18}$ salts of fatty acids with the given number of carbon atoms.

EDTA the salt of ethylenediaminetetraacetic acid.

Several representative recipes for detergents according to the invention are following.

| Components | Examples 1 | 2 | 3 | 4 |
|---|---|---|---|---|
| ABS | 8.0 | — | — | — |
| Olefinsulfonate | — | 8.0 | — | — |
| Fs-Estersulfonate | — | — | 7.0 | — |
| Soap $C_{12}$—$C_{22}$ | 4.0 | — | — | 3.0 |
| Soap $C_{16}$—$C_{18}$ | — | 2.0 | 3.0 | — |
| TA + 5 EO | 1.5 | — | — | — |
| TA + 14 EO | 2.5 | — | — | — |
| OA + 5 EO | — | — | — | 3.0 |
| Oxoalkohol $C_{12-15}$ + 7 EO | — | 3.0 | 3.0 | 8.0 |
| CMC | 1.5 | 1.5 | 1.5 | 1.5 |
| EDTA | 0.2 | 0.2 | 0.2 | 0.2 |
| Mg $SiO_3$ | 1.5 | 1.5 | 1.5 | 1.5 |
| Optical brightener | 0.15 | 0.3 | 0.15 | 0.3 |
| Foam inhibitor | — | 1.0 | 0.5 | — |
| Perborate | 25.0 | 30.0 | 20.0 | — |
| Aluminosilicate | 25.0 | 30.0 | 15.0 | 8.0 |
| Sodium carbonate | — | 7.0 | 15.0 | 12.0 |
| Na-silicate | 15.0 | 7.0 | 2.5 | 13.0 |
| 1-hydroxy-1-phenylmethan-diphosphonic acid | 6.0 | — | — | — |
| 1-amino-p-chlorphenyl-methandiphosphonic acid | — | 4.0 | — | — |
| 3-amino-1-hydroxypropane-1, 1-diphosphonic acid | — | — | 4.0 | — |
| 2-hydroxy-2,7-dioxo-3-amino-3-phosphonyl-1, 2,-azaphosphacycloheptane | — | — | — | 10.0 |
| Remainder $Na_2SO_4$ + water | | | | |

In Examples 1 and 5, the combination of the aluminosilicate and polyphosphonate compounds are combined with the particularly advantageous nonionic surface-active compound combinations, where nonionic compounds with 8 to 20 ethylene glycol units in the molecule are combined with nonionic compounds containing 2 to 6 ethylene glycol units per molecule, optionally, with anionic surface-active compounds added to the nonionic compounds.

The majority of the given recipes, and all those containing Perborate, is intended for use as so-called complete detergents for high temperature or boiling washing (approx. 95° C.), whereas the recipes without Perborate are for washing at intermediate temperatures, such as about 60° C. However, the detergents without Perborate may be used successfully also at higher temperatures, or as detergents for fine washables. Detergents for fine washables according to the invention usually have a higher proportion of tenside in the invention than the complete detergents described in the examples.

EXAMPLE 6

Washing tests were conducted with the detergent compositions of the invention in comparison to those employing pentasodium tripolyphosphate. The samples employed were cotton swatches soiled with a standard synthetic soil of skin fat, soot and pigmented dirt (supplied by Laundry Research Institute, Krefield, West Germany). These test swatches were washed under standard conditions in a "Launderometer" ® using a detergent of the following composition in percent by weight.

6.3% Sodium n-dodecylbenzene sulfonate
2.2% Ethoxylated tallow fatty alcohol (14 mols ethylene oxide)
3.4% Sodium soap (30% tallow fatty acids, 70% coconut fatty acids)
0.2% Sodium nitrilotriacetate
3.0% Sodium silicate ($Na_2O$:$SiO_2$=1:3.3)
24.0% Sodium perborate
1.4% Sodium carboxymethylcellulose
2.0 % Magnesium silicate
2.5% Sodium sulfate
Remainder: Aluminosilicate, phosphonate, tripolyphosphate, water (see Table).

The detergent concentration amounted to 7.5 gm/liter. The washing temperature was 90° C. sustained for 30 minutes plus a heat-up time of 15 minutes of from 20° C. to 90° C., the bath ratio (weight in gm of textile product to washing liquor in ml) 1:12, and the water hardness was 16° dH (16 mg CaO in 100 ml water). Following the wash, the samples were rinsed three times with tap water for 15 seconds and dried. The percent remission was measured by means of a photometer.

The phosphonates used were:

P 1: 1-hydroxy-1-phenylmethane-diphosphonate (sodium salt),

P 2: 1-amino-1-(p-chlorophenyl)-methane diphosphonate (sodium salt).

The aluminosilicate used was the crystalline product Aluminosilicate Im, having a calcium binding power of 170 mg CaO/gm As. For comparative purposes tests with sodium tripolyphosphate were also conducted.

TABLE

| Test | (Percent by weight) Alumino-silicate | Phos-phonate | Sodium tripoly-phosphate | % Remission |
|---|---|---|---|---|
| a | — | — | — | 59 |
| b | — | — | 5% | 63 |
| c | — | — | 10% | 73 |
| d | — | — | 15% | 80 |
| e | — | — | 40% | 83 |
| f | 40% | — | — | 73 |
| g | 40% | — | 5% | 76 |
| h | 40% | — | 10% | 81 |
| i | 40% | — | 15% | 83 |
| k | 40% | 6% P 1 | — | 83 |

TABLE-continued

| Test | Alumino-silicate | Phos-phonate | Sodium tripoly-phosphate | % Remission |
|---|---|---|---|---|
| | (Percent by weight) | | | |
| 1 | 40% | 6% P 2 | — | 83 |

The balance in each instance, except for Test i, to 100% by weight was water. Therefore, the composition of the invention Tests k and l, had 9% of water.

These results show that a combination of 40% aluminosilicate and 6% phosphonate produces the same rise in % remission as a combination of 40% aluminosilicate and 15% tripolyphosphate or an addition of 40% tripolyphosphate to an aluminosilicate-free detergent composition.

A detailed description of the preparation of the detergents according to the invention was omitted, since they can be prepared according to procedures well-known in the technology.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A process of treating soiled textiles by contacting soiled textiles with an aqueous liquor containing at least two compounds inhibiting alkaline earth metal ion precipitation on said soiled textiles as well as optionally at least one surface-active compound for a time sufficient to disperse or dissolve the soil from said soiled textiles into said aqueous liquor, separating said aqueous liquor and recovering said textiles substantially soil free, comprising using:

(1) from 0.2 to 10 gm of anhydrous active substance per liter of at least one finely-dispersed, water-insoluble silicate compound containing at least some combined water and having primary particles in the size range of from 100 $\mu$ to 0.01 $\mu$ and a calcium binding power of from 100 to 200 mg CaO/gm of anhydrous active substance when measured at 22° C. by the Calcium Binding Power Test Method set out in the specification, and the formula on the anhydrous basis $$(M_2O)_x.Me_2O_3.(SiO_2)_y$$

where M is a cation selected from the group consisting of sodium, lithium, potassium and ammonium, x is a number of from 0.7 to 1.5, Me is a member selected from the group consisting of aluminum and boron, and y is a number from 0.8 to 6, and (2) from 0.05 to 2 gm per liter of at least one water-soluble compound inhibiting alkaline earth metal ion precipitation selected from the group consisting of the free acid and acid salts of cations selected from the group consisting of alkali metals and ammonium of the following acids:

(A) An azacycloalkane-2,2-diphosphonic acid having the formula

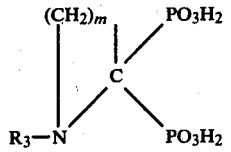

wherein m is an integer from 3 to 5 and $R_3$ is selected from the group consisting of hydrogen and alkyl and having 1 to 3 carbon atoms, (B) A cyclic aminophosphonic acid having the formula

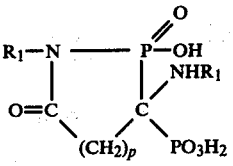

wherein p is an integer from 1 to 3 and $R_1$ is selected from the group consisting of hydrogen and alkyl having 1 to 6 carbon atoms, (C) Pyrrolidone-5,5-diphosphonic acid and N-alkylpyrrolidone-5,5-diphosphonic acid where alkyl has from 1 to 6 carbon atoms, (D) 3-amino-1-hydroxypropane-1,1-diphosphonic acid, and (E) A polyphosphonic acid having the formula

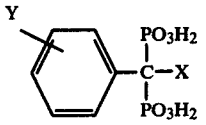

wherein X is a member selected from the group consisting of OH and $NH_2$ and Y is a member selected from the group consisting of hydrogen and halogen, with the proviso that when X is $NH_2$, Y is halogen, wherein the ratio of said water-soluble compond to said silicate compound in said aqueous liquor is from 1:8 to 2:1.

2. The process of claim 1 wherein, in said formula for said silicate compound, x is a number from 0.7 to 1.1 and y is a number from 1.3 to 3.3.

3. The process of claim 1 wherein said silicate compound is crystalline.

4. The process of claim 1 wherein said at least two compound inhibiting alkaline earth metal ion precipitation are employed in an amount whereby the residual hardness of said aqueous liquor is from 0.5° to 3° dH.

* * * * *

UNITED STATES PATENT AND TRADEMARK OFFICE

CERTIFICATE OF CORRECTION

PATENT NO. : 4,148,603

DATED : Apr. 10, 1979

INVENTOR(S) : Milan J. Schwuger, Heinz Smolka, Manfred Rostek

It is certified that error appears in the above-identified patent and that said Letters Patent are hereby corrected as shown below:

| Col. | Line | |
|---|---|---|
| 8 | 5 | "As" should be --AS-- |
| 9 | 52 | "As" both occurrence, should be -- AS --. |
| 12 | 7 | "can e" should be --can be-- |
| 15 | 13 | "IT" should be --It-- |
| 15 | 60 | "triacetylhydroxylamine" should be --triacetyl-hydroxylamine-- |
| 19 | 14 | "6 SiO hd 2" (prepared" should be --6 $SiO_2$ (prepared -- |
| 20 | 48 to Col. 21 line 2 | should be inserted into Col. 21 between lines 55 and 56 |

Signed and Sealed this

*Twenty-ninth* Day of *April 1980*

[SEAL]

*Attest:*

SIDNEY A. DIAMOND

*Attesting Officer*

*Commissioner of Patents and Trademarks*